US010807388B2

(12) United States Patent
Kizaki et al.

(10) Patent No.: US 10,807,388 B2
(45) Date of Patent: Oct. 20, 2020

(54) IMAGE FORMING APPARATUS AND METHOD FOR CONTROLLING PLURALITY OF HEATERS IN IMAGE FORMING APPARATUS

(71) Applicants: Osamu Kizaki, Saitama (JP); Junji Nakai, Kanagawa (JP); Masafumi Yamada, Kanagawa (JP); Shizuho Katahira, Kanagawa (JP)

(72) Inventors: Osamu Kizaki, Saitama (JP); Junji Nakai, Kanagawa (JP); Masafumi Yamada, Kanagawa (JP); Shizuho Katahira, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/579,292

(22) Filed: Sep. 23, 2019

(65) Prior Publication Data

US 2020/0101766 A1 Apr. 2, 2020

(30) Foreign Application Priority Data

Sep. 28, 2018 (JP) ..... 2018-183348

(51) Int. Cl.

| | |
|---|---|
| ***B41J 11/00*** | (2006.01) |
| ***B41J 11/08*** | (2006.01) |
| ***G03G 13/20*** | (2006.01) |
| ***G03G 15/20*** | (2006.01) |

(52) U.S. Cl.

CPC ..... *B41J 11/002* (2013.01); *B41J 11/08* (2013.01); *G03G 13/20* (2013.01); *G03G 15/2042* (2013.01)

(58) Field of Classification Search

CPC ..... B41J 11/002; B41J 11/08; G03G 13/20; G03G 15/2042

See application file for complete search history.

(56) References Cited

U.S. PATENT DOCUMENTS

| | | | | |
|---|---|---|---|---|
| 2008/0204537 | A1* | 8/2008 | Suzuki | B41J 11/002 347/102 |
| 2017/0192378 | A1* | 7/2017 | Hashiguchi | G03G 15/2039 |
| 2018/0154670 | A1* | 6/2018 | Sano | B41J 11/002 |
| 2019/0100032 | A1 | 4/2019 | Nakai et al. | |

FOREIGN PATENT DOCUMENTS

| | | |
|---|---|---|
| JP | 2013-064794 | 4/2013 |
| JP | 2015-136822 | 7/2015 |
| JP | 2017-007254 | 1/2017 |
| JP | 2019-064135 | 4/2019 |

* cited by examiner

*Primary Examiner* — Kristal Feggins
*Assistant Examiner* — Kendrick X Liu
(74) *Attorney, Agent, or Firm* — Duft & Bornsen, PC

(57) ABSTRACT

An image forming apparatus includes a plurality of heaters, a plurality of temperature sensors, an object sensor, and control circuitry. The temperature sensors are formed at positions corresponding to the heaters. The object sensor is configured to detect an overlap region of a medium and the heaters. The control circuitry is configured to correct temperature information acquired by the temperature sensors, according to the overlap region detected by the object sensor and the positions of the temperature sensors, and control the heaters based on the corrected temperature information.

10 Claims, 11 Drawing Sheets

| FIG. 4A | FIG. 4B |
|---|---|

IMAGE FORMING APPARATUS AND METHOD FOR CONTROLLING PLURALITY OF HEATERS IN IMAGE FORMING APPARATUS

CROSS-REFERENCE TO RELATED APPLICATION

This patent application is based on and claims priority pursuant to 35 U.S.C. § 119(a) to Japanese Patent Application No. 2018-183348, filed on Sep. 28, 2018, in the Japan Patent Office, the entire disclosure of which is hereby incorporated by reference herein.

BACKGROUND

Technical Field

Aspects of the present disclosure relate to an image forming apparatus, a method, and a recording medium.

Discussion of the Background Art

With diversification of business forms in the printing industry, various techniques for controlling an image forming apparatus have been required.

A technique for heating a paper sheet used as a recording medium in order to improve image quality of an image to be printed has been known. For example, some inkjet type image forming apparatuses include a heating mechanism for drying ink droplets discharged on a surface of the recording medium. A laser type image forming apparatus generally heats the recording medium to fix a toner. In particular, there is a case where an industrial image forming apparatus uses a large paper sheet as a recording medium, and appropriate temperature control of the recording medium is required.

In a case where the temperature of the recording medium is not appropriate and temperature distribution is not uniform, thermal expansion of the recording medium locally occurs, and cockling occurs. As a result, the image quality is deteriorated. Furthermore, in a case where heating for drying the ink droplets is not sufficiently performed in the inkjet type image forming apparatus, there is a case where other recording medium laminated on the upper side may be blocked. In addition, in a case where the heating is excessively performed, there is a case where expansion (blister) of air in the recording medium occurs. These symptoms cause the deterioration in the image quality and an abnormality in conveyance of the recording medium.

SUMMARY

In an aspect of the present disclosure, there is provided an image forming apparatus that includes a plurality of heaters, a plurality of temperature sensors, an object sensor, and control circuitry. The temperature sensors are formed at positions corresponding to the heaters. The object sensor is configured to detect an overlap region of a medium and the heaters. The control circuitry is configured to correct temperature information acquired by the temperature sensors, according to the overlap region detected by the object sensor and the positions of the temperature sensors, and control the heaters based on the corrected temperature information.

In another aspect of the present disclosure, there is provided a method for controlling a plurality of heaters formed in an image forming apparatus. The method includes acquiring, detecting, correcting, and controlling. The acquiring acquires temperature information at positions of the heaters with a plurality of temperature sensors. The detecting detects an overlap region of the medium and the heaters. The correcting corrects the temperature information acquired by the temperature sensors, according to the detected overlap region and positions of the temperature sensors. The controlling controls the heaters based on the corrected temperature information.

BRIEF DESCRIPTION OF THE DRAWINGS

A more complete appreciation of the disclosure and many of the attendant advantages and features thereof can be readily obtained and understood from the following detailed description with reference to the accompanying drawings, wherein.

Figure 1:
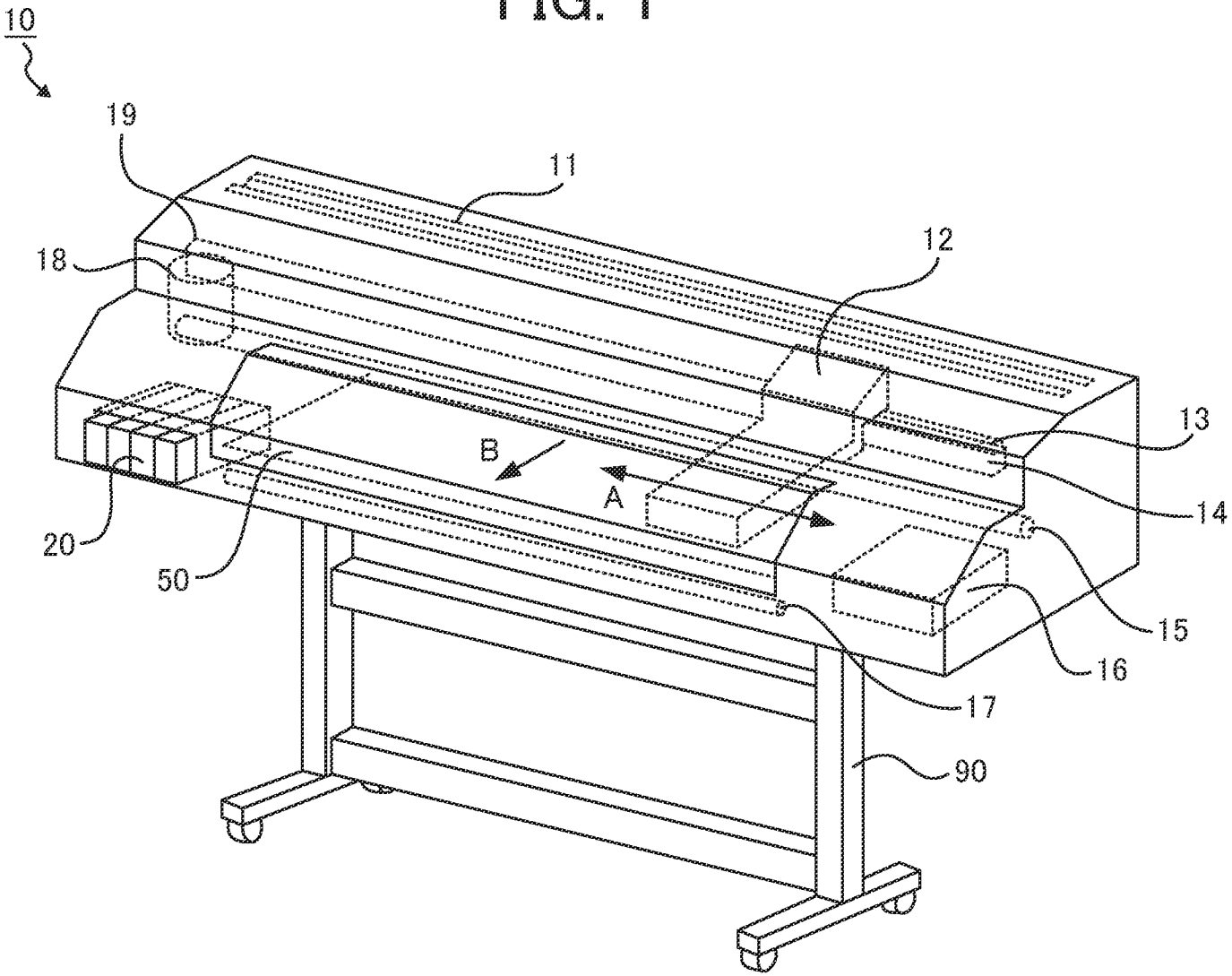
FIG. 1 is a diagram illustrating a schematic configuration of an image forming apparatus according to an embodiment of the present invention.

The accompanying drawings are intended to depict embodiments of the present invention and should not be interpreted to limit the scope thereof. The accompanying drawings are not to be considered as drawn to scale unless explicitly noted.

DETAILED DESCRIPTION

The terminology used herein is for the purpose of describing particular embodiments only and is not intended to be limiting of the present invention. As used herein, the singular forms "a", "an" and "the" are intended to include the plural forms as well, unless the context clearly indicates otherwise.

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result. In the drawings to be referred below, common components are denoted with the same reference numeral, and description of the common component will be appropriately omitted. Furthermore, hereinafter, an inkjet type image forming apparatus using a paper sheet 50 as a recording medium will be described as an example. However, the embodiment is not limited to this.

FIG. 1 is a diagram illustrating a schematic configuration of an image forming apparatus 10 according to an embodiment of the present invention. The image forming apparatus 10 illustrated in FIG. 1 has a configuration in which a frame 90 supports a main body. On an inner side of both side plates of the main body of the image forming apparatus 10, a guide rod 15 and a secondary guide rod 11 are bridged. A timing belt 13 is bridged to connect a drive pulley 19 and a pressure pulley 14 arranged in a direction along each guide rod. The drive pulley 19 is rotated by a main scanning motor 18 and drives the timing belt 13. Furthermore, the pressure pulley 14 can apply tension to the timing belt 13, and accordingly, the timing belt 13 can be rotationally driven without slack.

A carriage 12 is held by the guide rod 15, the secondary guide rod 11, and the timing belt 13. With this structure, the carriage 12 can reciprocate in an arrow A direction in FIG. 1. Hereinafter, the A direction is referred to as a "main scanning direction". The carriage 12 includes recording heads 23 to be described later, moves in the main scanning direction, and discharges ink from a plurality of nozzles included in the recording heads 23 to form an image on the paper sheet 50 which is conveyed in a direction indicated by arrow B in FIG. 1. Hereinafter, the direction indicated by arrow B is referred to as a "sub-scanning direction".

Figure 2:
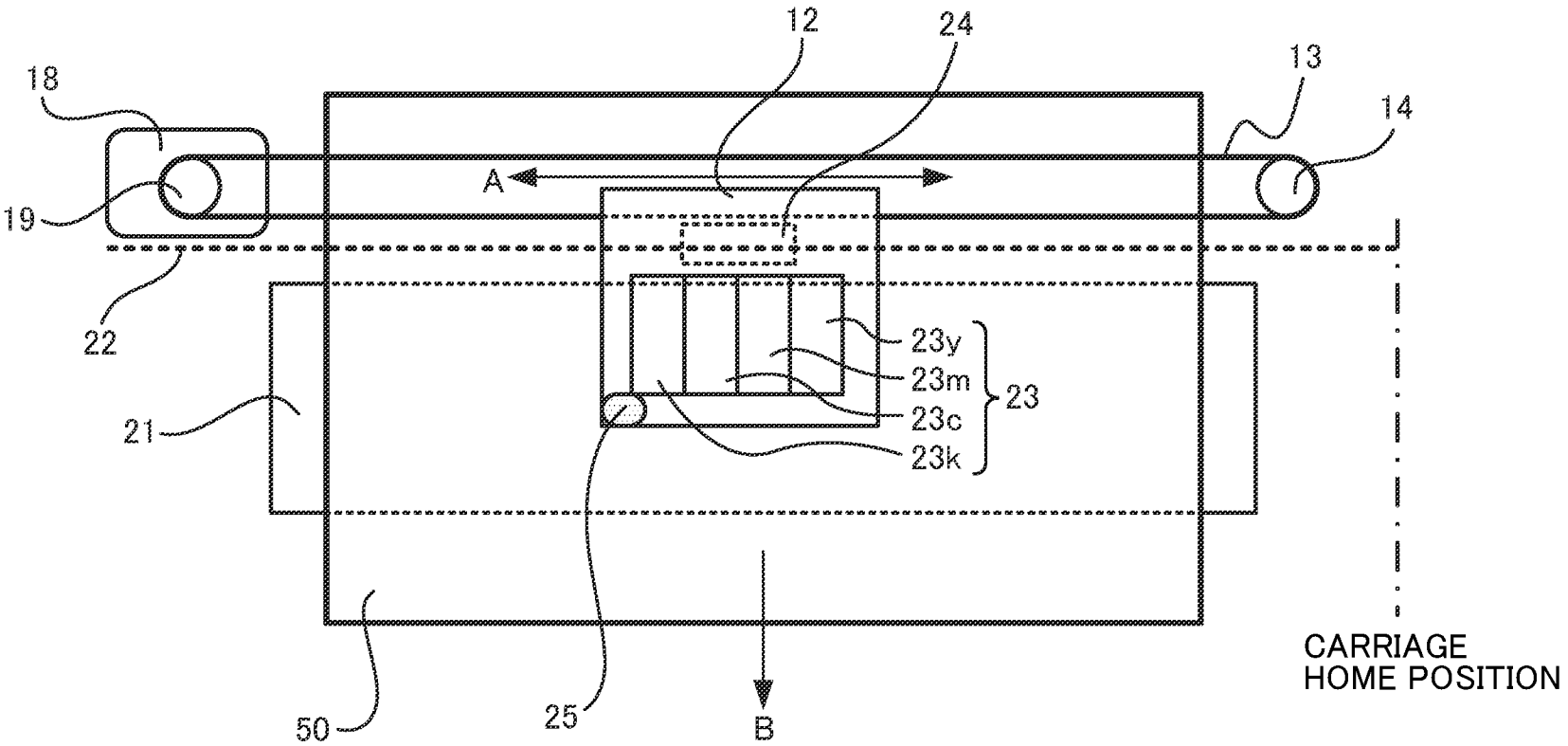
FIG. 2 is a schematic view illustrating a configuration of a carriage scanning mechanism of the image forming apparatus according to the present embodiment.

Furthermore, the image forming apparatus 10 includes a cartridge 20 which supplies ink to the recording heads 23 (see FIG. 2). The paper sheet 50 on which the ink is discharged and an image is formed is heated by a heating device 17, and ink drying processing is performed on the paper sheet 50. The heating device 17 may include a plurality of heating devices or may have a configuration for performing a heating process before or during the ink discharge. Moreover, the image forming apparatus 10 includes a maintenance mechanism 16 which maintains the plurality of nozzles included in the recording heads 23, and clogging of the nozzles and the like can be prevented by periodic maintenance processing.

FIG. 2 is a schematic view illustrating a configuration of a carriage scanning mechanism of the image forming apparatus 10 according to the present embodiment. The carriage 12 includes recording heads 23*k*, 23*c*, 23*m*, and 23*y* as the recording heads 23, a main scanning encoder sensor 24, and an object detection sensor 25. The carriage 12 moves in the main scanning direction and the paper sheet 50 is conveyed in the sub-scanning direction so that the ink can be discharged at an arbitrary position on the paper sheet 50. Heads of the recording head 23*k*, the recording head 23*c*, the recording head 23*m*, and the recording head 23*y* respectively include nozzles for discharging inks of black (K), cyan (C), magenta (M), and yellow (Y), and the inks of these colors are combined to form a color image.

The recording heads 23 discharge different colors of inks, which are supplied from the cartridge 20 illustrated in FIG. 1, from the nozzles to form a desired image. By moving the main scanning encoder sensor 24 in the main scanning direction while reading an encoder sheet 22, the carriage 12 can appropriately acquire a position of the carriage 12. Therefore, the carriage 12 can discharge the ink at an appropriate position on the paper sheet 50.

A platen 21 is arranged to face the carriage 12 and supports the paper sheet 50 conveyed in the sub-scanning direction from a lower side. The object detection sensor 25 mounted on the carriage 12 detects an object below the carriage 12. With this detection, it is possible to identify whether the position of the carriage 12 is in an area outside the platen 21, in an area on the platen 21, or in an area on the paper sheet 50. In addition, by combining detection information by the object detection sensor 25 and an encoder value of the main scanning encoder sensor 24, a dimension of the paper sheet 50 in the main scanning direction can be calculated.

A carriage home position indicated by an alternate long and short dash line in FIG. 2 is a position to be a reference for the carriage 12 to move in the main scanning direction. The carriage home position can be set to an arbitrary position and, for example, can be set above the maintenance mechanism 16 illustrated in FIG. 1.

Figure 3:
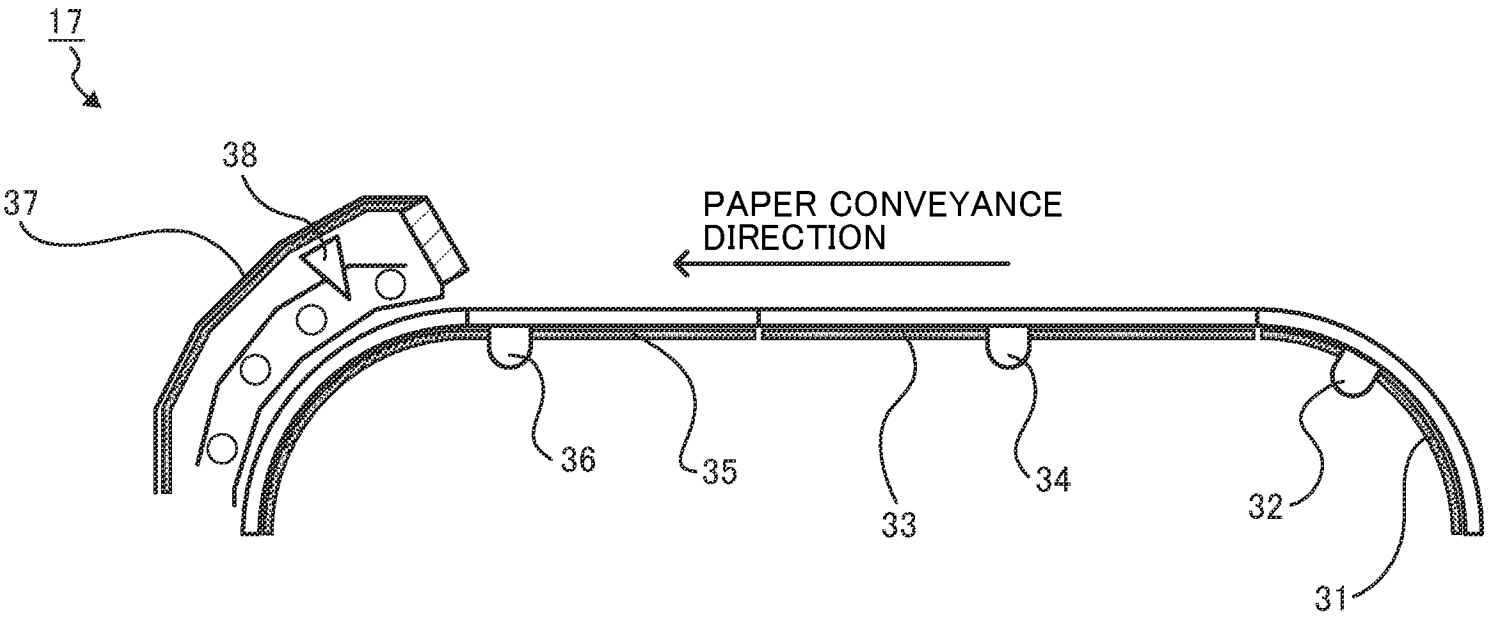
FIG. 3 is a cross-sectional view illustrating a configuration of a heating device according to the present embodiment.

FIG. 3 is a cross-sectional view illustrating a configuration of the heating device 17 according to the present embodiment. The heating device 17 heats the paper sheet 50 by various methods to maintain the flatness of the paper sheet 50 in the image forming process and to promote drying of the ink after the image has been formed. Therefore, it is preferable that the heating device 17 include a plurality of heating devices according to an effect of heating. As illustrated in FIG. 3, in the heating device 17 according to the present embodiment, a preheater 31, a platen heater 33, a post heater 35, and a cure heater 37 are arranged along a paper conveyance direction. The paper conveyance direction is a direction corresponding to the sub-scanning direction.

The preheater 31 is a unit which heats the paper sheet 50 before the image forming process. By preheating the preheater 31, moisture of the ink is easily evaporated when an ink droplet lands on the paper sheet 50. As a result, since the ink can be quickly dried, image quality can be improved.

The platen heater 33 is a unit which heats the platen 21 arranged below a flow line of the carriage 12 and is intended to heat the paper sheet 50 together with the landed ink droplet and form a film on the surface of the ink droplet. By forming the film on the ink surface by heating the ink droplet, a size of the ink droplet can be adjusted to an appropriate size, and deterioration in the image quality can be prevented.

The post heater 35 is a unit which further heats the paper sheet 50 on which the ink droplet is landed and which is conveyed. By continuing to heat the ink by the post heater 35 after the ink has been landed, the moisture and the solvent of the ink are evaporated, and drying of the ink is accelerated.

The cure heater 37 is a unit which heats the ink surface from an inside of the ink by far infrared rays. By heating the ink from inside by the cure heater 37, a polymerization reaction of ink resin is caused so as to cure the ink and fix the ink on the paper sheet 50.

In addition, temperature sensors 32, 34, 36, and 38 which measure the temperatures of the conveyance surface and the paper sheet 50 are provided in the vicinity of the respective heaters 31, 33, 35, and 37. Each heater is controlled to have a predetermined temperature based on temperature data measured by each temperature sensor. In the example illustrated in FIG. 3, thermistors are used as a preheater portion temperature sensor 32, a platen heater portion temperature sensor 34, and a post heater portion temperature sensor 36 and attached to the conveyance surface to measure the temperature of the conveyance surface. A non-contact type thermopile and the like can be used as a cure heater portion temperature sensor 38 and measures the temperature of the paper sheet 50 to be conveyed.

Figures 4, 4A:
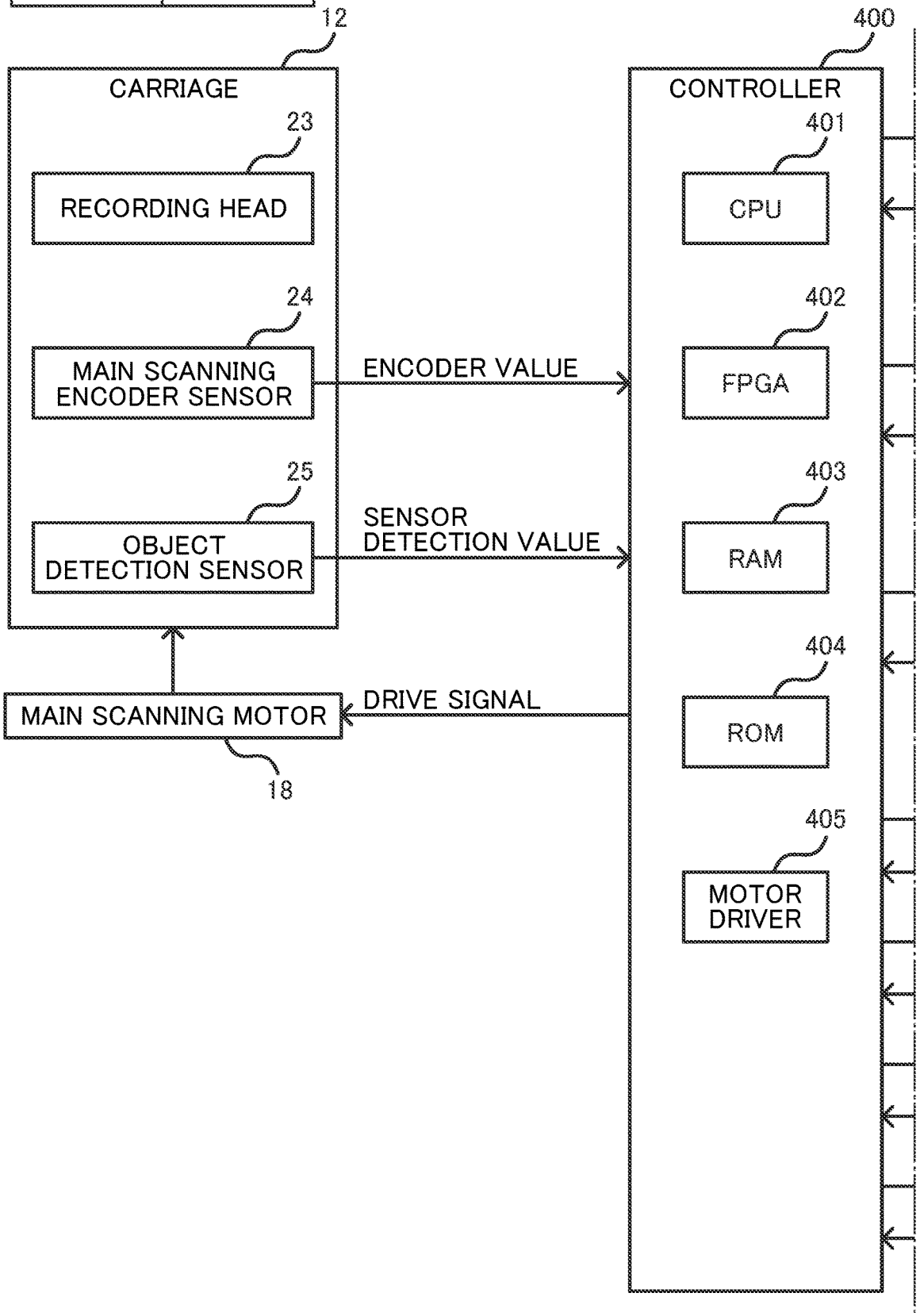
FIG. 4 (including FIGS. 4A and 4B) is a diagram illustrating a hardware configuration included in the image forming apparatus according to the present embodiment.
Figure 4B:
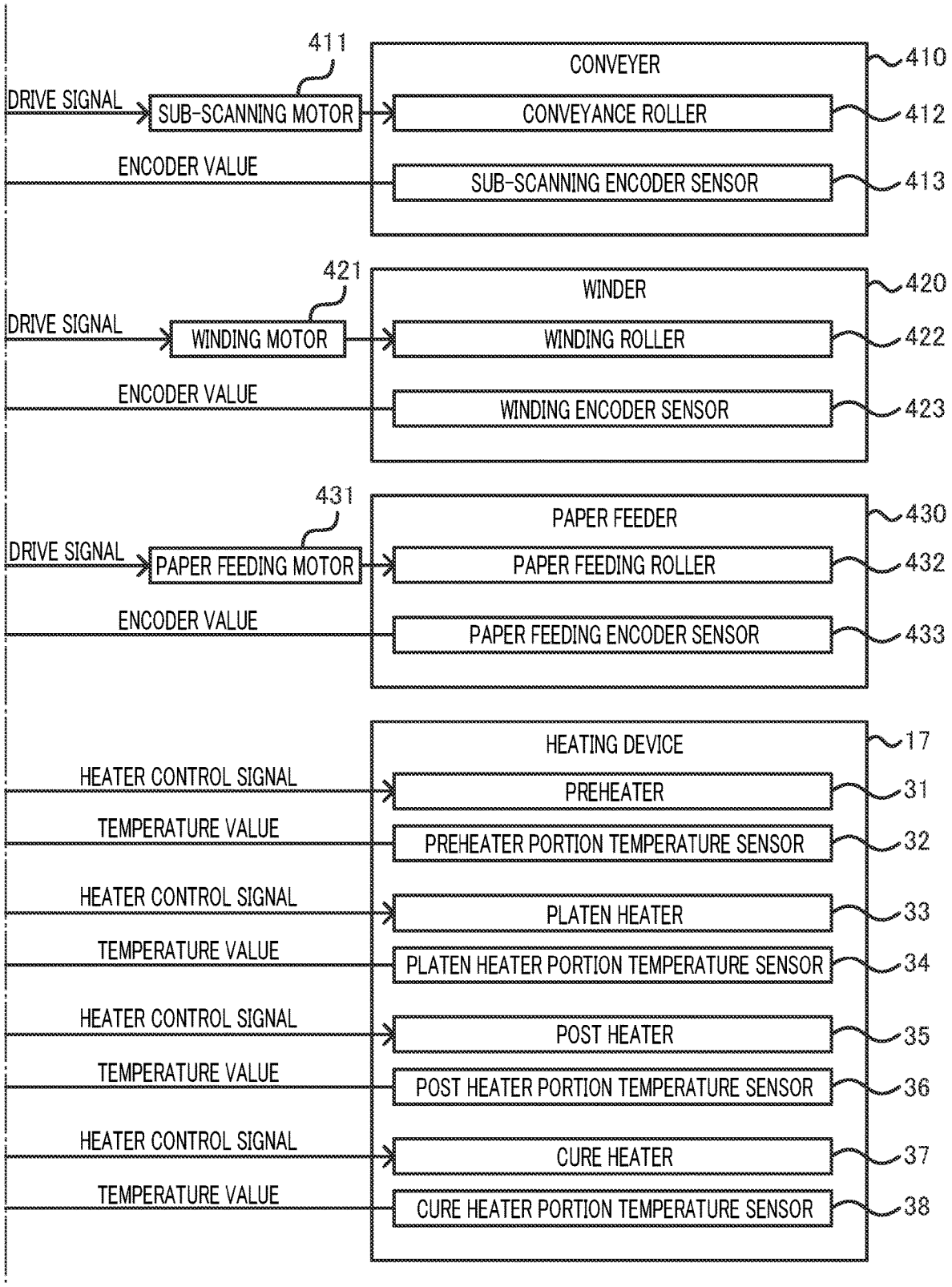

Next, a hardware configuration of the image forming apparatus 10 will be described. FIG. 4 is a diagram illustrating a hardware configuration included in the image forming apparatus 10 according to the present embodiment. The image forming apparatus 10 according to the present embodiment includes a controller 400, a conveyer 410, a winder 420, and a paper feeder 430 as illustrated in FIG. 4, in addition to the carriage 12, the main scanning motor 18, and the heating device 17 described with reference to FIGS. 1 to 3.

The controller 400 is a unit which controls an operation of the image forming apparatus 10, receives signals from various hardware, and outputs control signals. The controller 400 includes a central processing unit (CPU) 401, a field programmable gate array (FPGA) 402, a random access memory (RAM) 403, a read only memory (ROM) 404, and a motor driver 405.

The CPU 401 is a device which executes a program for controlling the operation of the image forming apparatus 10 and executes predetermined processing. The FPGA 402 is an integrated circuit provided for image processing and has a configuration specific for a specific application. Therefore, the FPGA 402 can execute processing at a faster speed than the CPU 401.

The RAM 403 is a volatile storage device which provides a space for executing the programs executed by the CPU 401 and the FPGA 402 and used to store and develop programs and data. The ROM 404 is a non-volatile storage device which stores programs, firmware, and the like executed by the CPU 401 and the FPGA 402.

The motor driver 405 is a unit which controls various motors included in the image forming apparatus 10 and outputs drive signals calculated by the CPU 401 and the FPGA 402 to various motors.

The carriage 12 reciprocates in the main scanning direction by the main scanning motor 18 which has received a drive control signal from the controller 400. According to the movement of the carriage 12, the main scanning encoder sensor 24 reads the encoder sheet 22 and outputs the encoder value to the controller 400. The object detection sensor 25 mounted on the carriage 12 detects whether or not the platen 21 and the paper sheet 50 are provided at a position facing the carriage 12 and outputs the detection result to the controller 400. The controller 400 controls the image forming processing based on the encoder value and a sensor detection value.

A sub-scanning motor 411 which has received the control signal from the controller 400 controls an operation of a conveyance roller 412 so that the conveyer 410 conveys the paper sheet 50 on the conveyance surface in the sub-scanning direction. The conveyer 410 includes a sub-scanning encoder sensor 413, acquires a movement amount of the paper sheet 50 in the sub-scanning direction, and outputs the acquired movement amount to the controller 400 as an encoder value.

After drying the paper sheet 50, the winder 420 can arbitrarily change a print start position, for example, by winding the paper sheet 50 to adjust the print start position to a rear end position of the image which has been already formed. In the winder 420, a winding motor 421 which has received the control signal from the controller 400 controls an operation of a winding roller 422. The winder 420 includes a winding encoder sensor 423 and outputs a value to the controller 400 as an encoder value.

A paper feeding motor 431 which has received the control signal from the controller 400 controls an operation of a paper feeding roller 432 so that the paper feeder 430 moves the paper sheet 50 from a paper feeding tray to the conveyance surface. Furthermore, the paper feeder 430 includes a paper feeding encoder sensor 433 and outputs the movement amount of the paper sheet 50 to the controller 400 as an encoder value.

As illustrated in FIG. 3, the heating device 17 includes the preheater 31, the preheater portion temperature sensor 32, the platen heater 33, the platen heater portion temperature sensor 34, the post heater 35, the post heater portion temperature sensor 36, the cure heater 37, and the cure heater portion temperature sensor 38. Various heaters are aligned in the sub-scanning direction, and the temperature of each heater is controlled in response to a heater control signal from the controller 400. Furthermore, each temperature sensor is provided in the vicinity of the heater, measures the temperatures of the conveyance surface and the paper sheet 50 heated by each heater, and feeds back the measured temperature to the controller 400 as a temperature value. With this operation, the temperature can be controlled based on the temperature data measured by the various heaters, and the temperature of the paper sheet 50 can be appropriately controlled. As described later in the present embodiment, a configuration may be used in which various heaters are divided in the sub-scanning direction and the temperatures of the divided heaters are separately controlled. With this configuration, a heater control signal according to the position and the size of the paper sheet 50 can be output, and the temperature of the paper sheet 50 can be more appropriately controlled.

Figure 5:
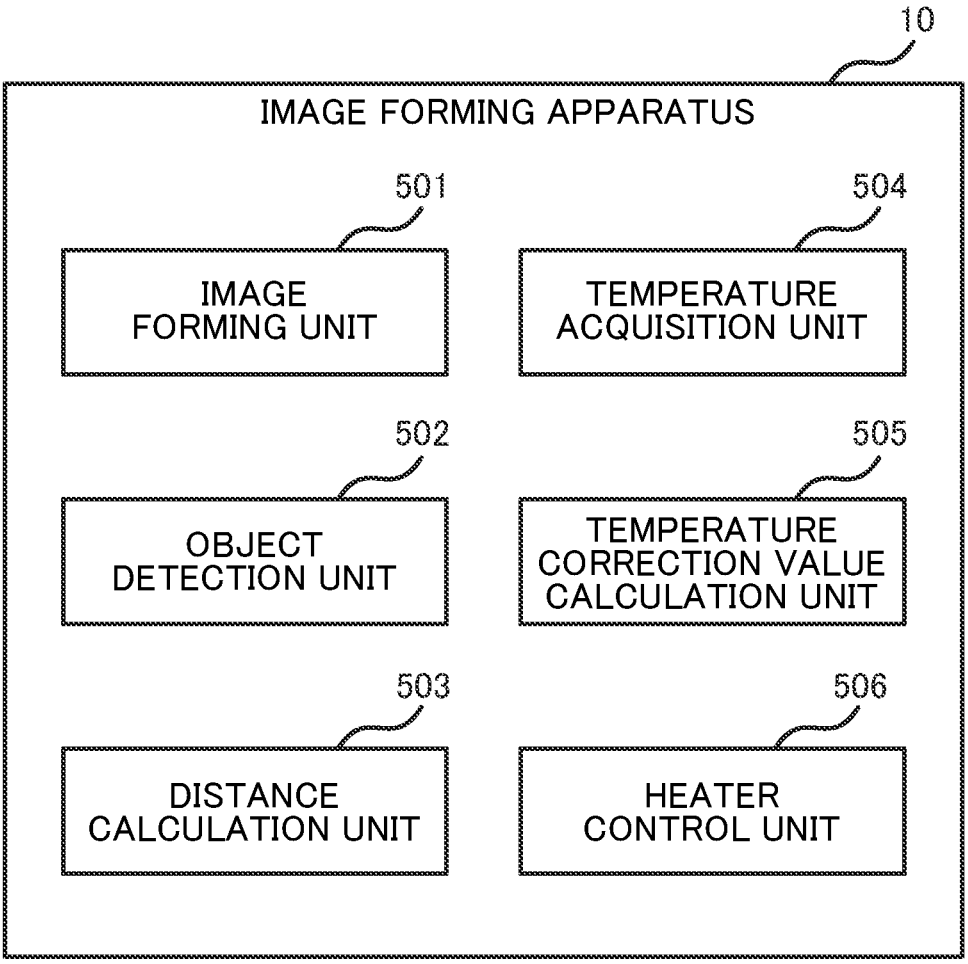
FIG. 5 is a block diagram of software included in the image forming apparatus according to the present embodiment.

The hardware configuration included in the image forming apparatus 10 according to the present embodiment has been described above. Next, functional units executed by each hardware according to the present embodiment will be described with reference to FIG. 5. FIG. 5 is a block diagram of software included in the image forming apparatus 10 according to the present embodiment.

The image forming apparatus 10 includes modules such as an image forming unit 501, an object detection unit 502, a distance calculation unit 503, a temperature acquisition unit 504, a temperature correction value calculation unit 505, and a heater control unit 506. Details of each functional unit will be described below.

The image forming unit 501 is a unit which controls the operations of the carriage 12, the conveyer 410, and the like based on a print job input from a personal computer terminal and the like and forms an image on the surface of the paper sheet 50.

The object detection unit 502 is a unit which controls the object detection sensor 25 mounted on the carriage 12 and detects whether or not an object exists below the carriage 12 which moves in the main scanning direction. For example, in a case where the object detection sensor 25 includes a light-emitting diode (LED) and a reflected light sensor, the object detection unit 502 can detect whether or not the object exists according to reflected light of light irradiated to the object. Furthermore, the object detection unit 502 can have a configuration which can identify whether the object existing below the carriage 12 is the platen 21 or the paper sheet 50 based on a light reflectance, a distance to the object, and the like.

The distance calculation unit 503 is a unit which calculates a width of the paper sheet on which an image is formed. For example, the distance calculation unit 503 can calculate the dimension of the paper sheet 50 existing below the carriage 12 in the main scanning direction based on the detection result regarding whether or not the object exists by the object detection unit 502 and the encoder value of the main scanning encoder sensor 24.

The temperature acquisition unit 504 is a unit which controls various temperature sensors 32, 34, 36, and 38 and acquires the temperature values of the conveyance surface and the paper sheet 50. In a case where the configuration includes the heaters divided in the main scanning direction, the temperature acquisition unit 504 can have a configuration which can acquire the temperature value for each of the divided heaters.

The temperature correction value calculation unit 505 is a unit which calculates a correction value for controlling the temperature of each heater based on the width of the paper sheet calculated by the distance calculation unit 503 and the temperature value acquired by the temperature acquisition unit 504. The temperature correction value calculation unit 505 refers to a predetermined function and table and calculates the correction value for controlling the temperature of the heater to be a predetermined temperature.

The heater control unit 506 is a unit which outputs signals used to control various heaters 31, 33, 35, and 37 so as to control the temperature of the heater. To control the temperature of the heater to the predetermined temperature, the heater control unit 506 can output a predetermined temperature control signal and a control signal based on the correction value calculated by the temperature correction value calculation unit 505.

The software block described above corresponds to a functional unit implemented by functioning each of the hardware by executing the program of the present embodiment by the CPU 401 and the FPGA 402. All the functional units indicated in each embodiment may be implemented as software, and a part or all of the functional units can be implemented as hardware providing equivalent functions.

Figure 6A:
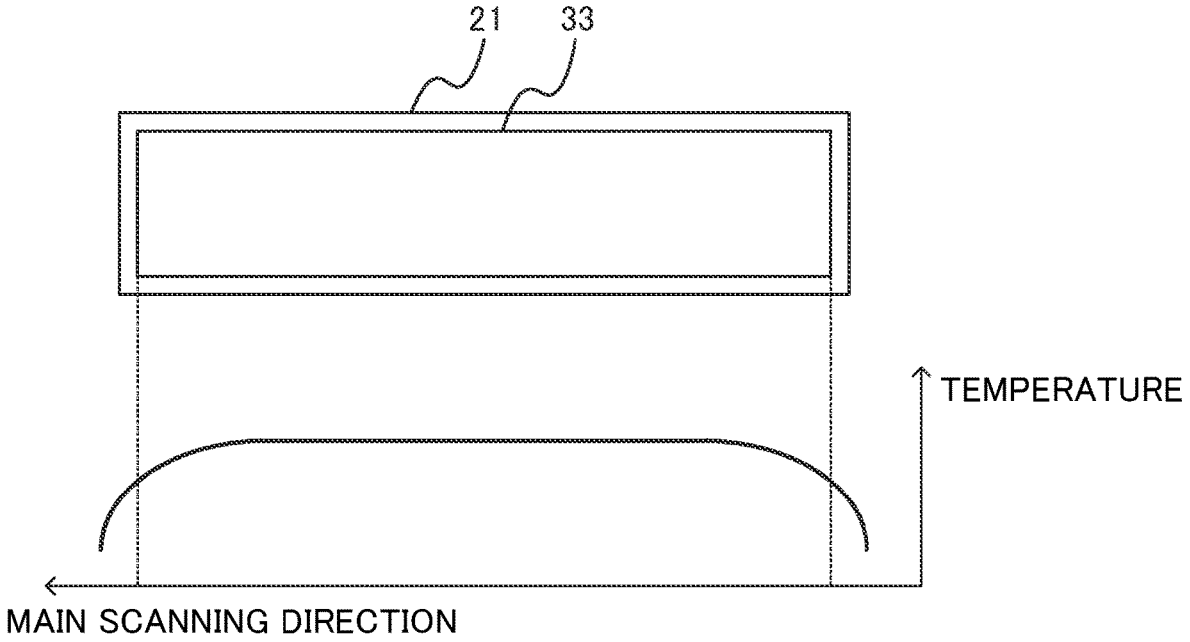
FIGS. 6A and 6B are diagrams for explaining a difference in temperature distribution depending on whether heaters are divided.
Figure 6B:
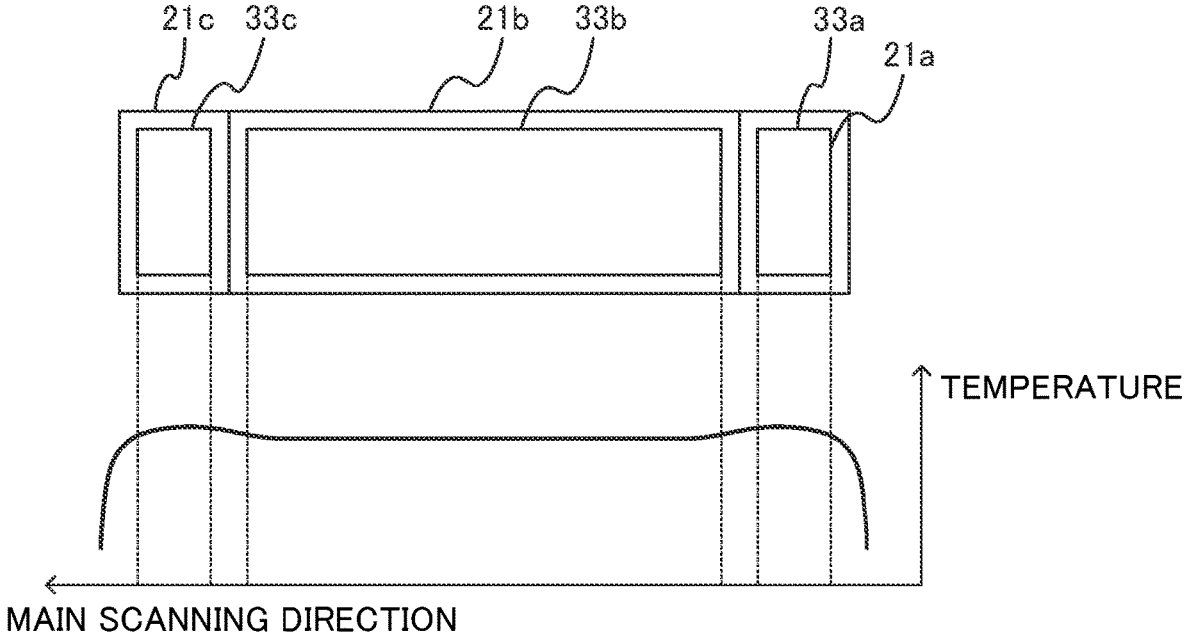

FIGS. 6A and 6B are diagrams for explaining a difference in temperature distribution depending on whether the heaters are divided and illustrates configurations of the platen 21 and the platen heater 33 and the temperature distribution in the main scanning direction on the conveyance surface. In the example illustrated in FIGS. 6A and 6B, the platen 21 is heated to heat the conveyance surface of the paper sheet 50. FIG. 6A illustrates an example including a single platen heater 33, and FIG. 6B illustrates an example including a plurality of platen heaters 33*a* to 33*c* divided in the main scanning direction. Note that the platen heater 33 is described as an example in the following description. However, the embodiment is not limited to this, and the embodiment may have a configuration in which other heaters including the preheater 31, the post heater 35, the cure heater 37, and the like are divided in the main scanning direction.

First, FIG. 6A will be described. Since the single heater is included in the platen 21 having the configuration illustrated in FIG. 6A, temperature control according to the position in the main scanning direction cannot be performed. Therefore, since heat is transmitted to the outside in the vicinity of both ends of the platen 21 where the platen heater 33 is not provided, the temperature of the both ends of the platen 21 is higher than the temperature of the central portion of the platen 21. Therefore, as in the lower diagram in FIG. 6A, the temperature distribution is uneven, and a temperature gradient occurs, and this makes it difficult to uniformly heat the paper sheet 50.

On the other hand, in the configuration illustrated in FIG. 6B, the platen heater 33 is divided into three portions in the main scanning direction. The temperature of each of the divided platen heaters 33*a* to 33*c* can be separately controlled. The number of heaters divided in the main scanning direction does not need to be three as illustrated in FIG. 6B, and the heater can be divided into any number. FIG. 6B illustrates an example in which the platen 21 is divided in the main scanning direction similarly to the platen heater 33 for the sake for convenience. However, it is not necessary to divide the platen 21, and the single platen 21 may be included.

As illustrated in FIG. 6B, in the present embodiment, the platen heater 33 is divided in the main scanning direction, and the temperature of each of the platen heaters 33*a* to 33*c* is independently controlled. At this time, the temperatures of the platen heaters 33*a* and 33*c* at both ends are controlled to be set to be higher than the temperature of the platen heater 33*b* at the center. That is, by controlling the temperatures in consideration of heat radiation from the platens 21*a* and 21*c* on both ends from which heat is easily transmitted to the outside, the temperature distribution in the main scanning direction can be uniformed, and the paper sheet 50 can be appropriately heated.

As described with reference to FIGS. 6A and 6B above, to make the temperature distribution be uniform, it is preferable to divide the heater in the main scanning direction and separately control the temperatures of the divided heaters. On the other hand, in an actual image forming process, even in a case where the conveyance surface such as the platen 21 is appropriately heated, the heat is radiated to the paper sheet 50 to be conveyed, and the temperature value of the conveyance surface detected by the temperature sensor is lowered. Therefore, it is preferable to correct the temperature according to the positional relationship between the platen heater portion temperature sensor 34 and the paper sheet 50. In particular, in the present embodiment, in a case where the platen heater portion temperature sensor 34 and the paper sheet 50 are overlapped with each other, the temperature value detected by the sensor is corrected so that the paper sheet 50 can be heated to an appropriate temperature.

Figure 7A:
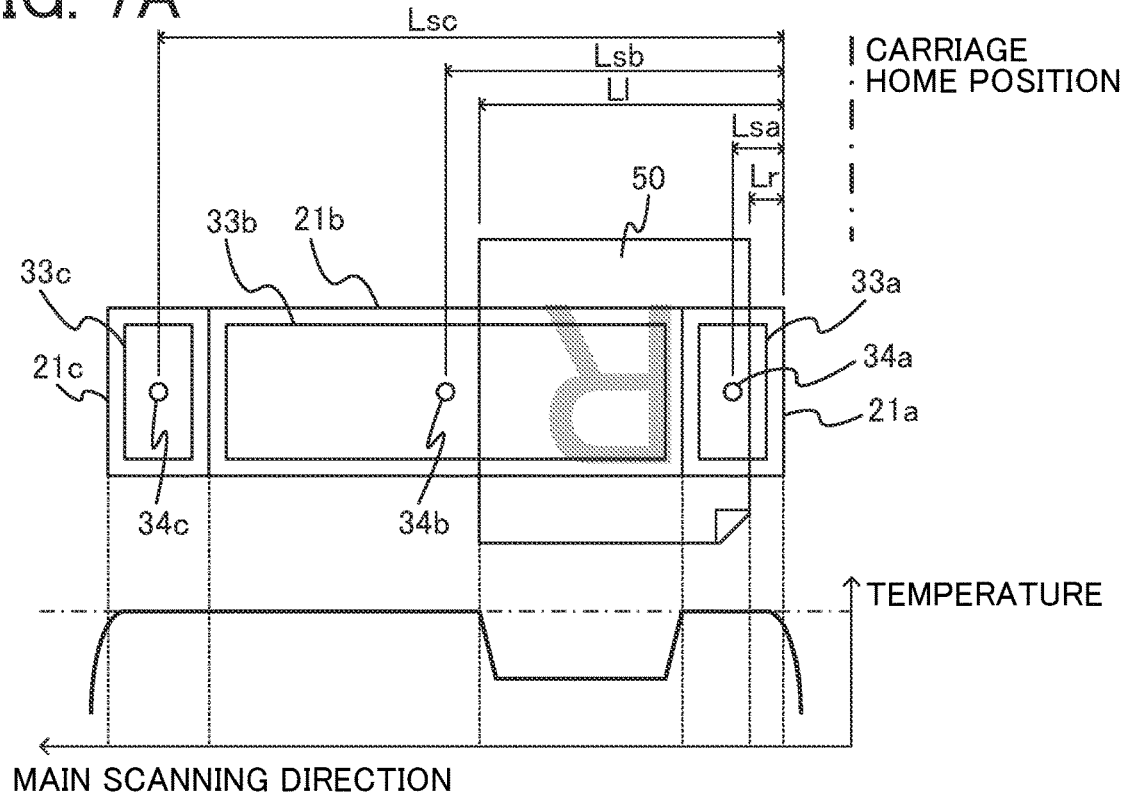
FIGS. 7A and 7B are diagrams illustrating an example of temperature control based on presence or absence of a paper sheet in the present embodiment.
Figure 7B:
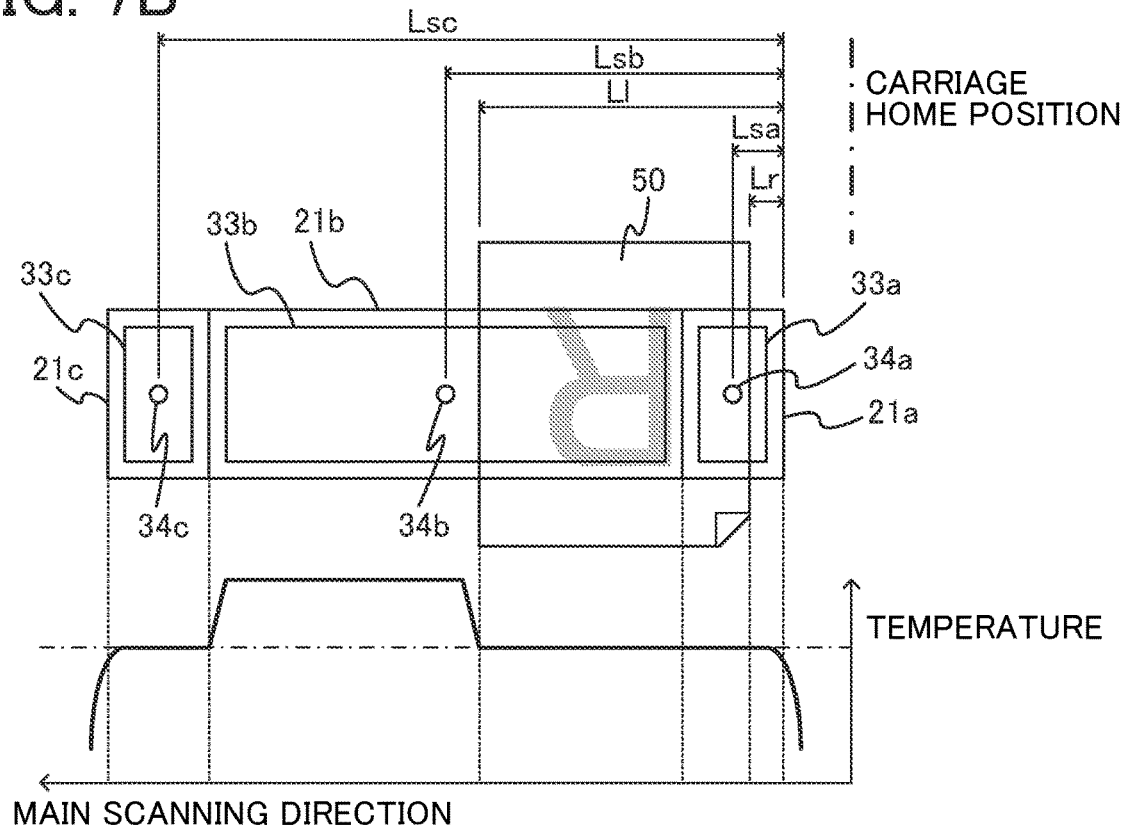

FIGS. 7A and 7B are diagrams illustrating an example of temperature control based on presence or absence of the paper sheet 50 in the present embodiment. In FIGS. 7A and 7B, an alternate long and short dash line indicated by a light color indicates an example of an appropriate temperature of the paper sheet 50 in the image forming process. References Ll and Lr in FIGS. 7A and 7B indicate lengths from a right end of the platen 21 to both ends of the paper sheet 50 and can be obtained by the object detection unit 502 and the distance calculation unit 503. A difference between the lengths Ll and Lr is a width of the paper sheet 50 in the main scanning direction. Processing for calculating the lengths Ll and Lr will be described later.

Furthermore, references Lsa, Lsb, and Lsc in FIGS. 7A and 7B are distances from the right end of the platen 21 to the respective platen heater portion temperature sensors 34*a*, 34*b*, and 34*c*. The references Lsa, Lsb, and Lsc are known values determined in design of the image forming apparatus 10. FIG. 7A illustrates temperature distribution by conventional temperature control to which the present embodiment is not applied, and FIG. 7B illustrates temperature distribution in a case where the paper sheet 50 is heated by temperature control according to the present embodiment. In FIGS. 7A and 7B, a case where the platen heater 33 is divided into three portions in the main scanning direction as in FIGS. 6A and 6B will be described as an example.

First, FIG. 7A will be described. In the example in FIG. 7A, the paper sheet 50 is heated by the platen heater 33*a* on the right side and the platen heater 33*b* at the center.

Furthermore, the platen heater portion temperature sensor 34*a* on the right side is overlapped with the paper sheet 50, and the platen heater portion temperature sensor 34*b* at the center does not overlap with the paper sheet 50. Each of the platen heaters 33*a* to 33*c* heats the paper sheet 50 based on each of the temperature values detected by the corresponding platen heater portion temperature sensors 34*a* to 34*c*. Therefore, in such a case, the temperature distribution is as illustrated in the lower diagram in FIG. 7A.

That is, as in the temperature distribution in FIG. 7A, while a region of the paper sheet 50 heated by the platen heater 33*a* on the right side has an appropriate temperature, a temperature of a region heated by the platen heater 33*b* at the center is lower. This is because, since the platen heater portion temperature sensor 34*b* at the center does not overlap with the paper sheet 50, the temperature value detected by the sensor does not indicate the temperature of the paper sheet 50, and temperature control in consideration of the heat radiation by the paper sheet 50 cannot be performed.

Therefore, in the present embodiment, as illustrated in FIG. 7B, it is preferable to perform the temperature control after the temperature of the platen heater 33*b* at the center is increased and a measurement value of the platen heater portion temperature sensor 34 is corrected to as to control the temperature of the paper sheet 50 to be an appropriate temperature. That is, in a region of the platen 21*b* at the center where the temperature sensor 34*a* does not overlap with the paper sheet 50, the temperature value detected by the temperature sensor is not the temperature of the paper sheet 50 and is the temperature of the platen 21*b* to which the heat of the paper sheet 50 is dissipated. Therefore, the detected temperature value is corrected by a parameter according to a distance from the temperature sensor 34*a* to the paper sheet 50, and the temperature of the platen heater 33*b* is controlled based on the corrected temperature value. In the region of the platen 21*a* on the right side where the temperature sensor 34*a* overlaps with the paper sheet 50, the temperature value output from the temperature sensor 34*a* corresponds to the temperature of the paper sheet 50. Therefore, the temperature is controlled by using the temperature value as in FIG. 7A.

By controlling the temperature as described above, as illustrated in the temperature distribution in the lower diagram in FIG. 7B, a region where the paper sheet 50 exists can be heated to an appropriate temperature. Furthermore, in consideration of the heat radiation by the paper sheet 50, the temperature is controlled so that the paper sheet 50 has an appropriate temperature. Therefore, a temperature in a region with no paper sheet 50 in the region of the platen 21*b* at the center becomes higher.

Figure 8:
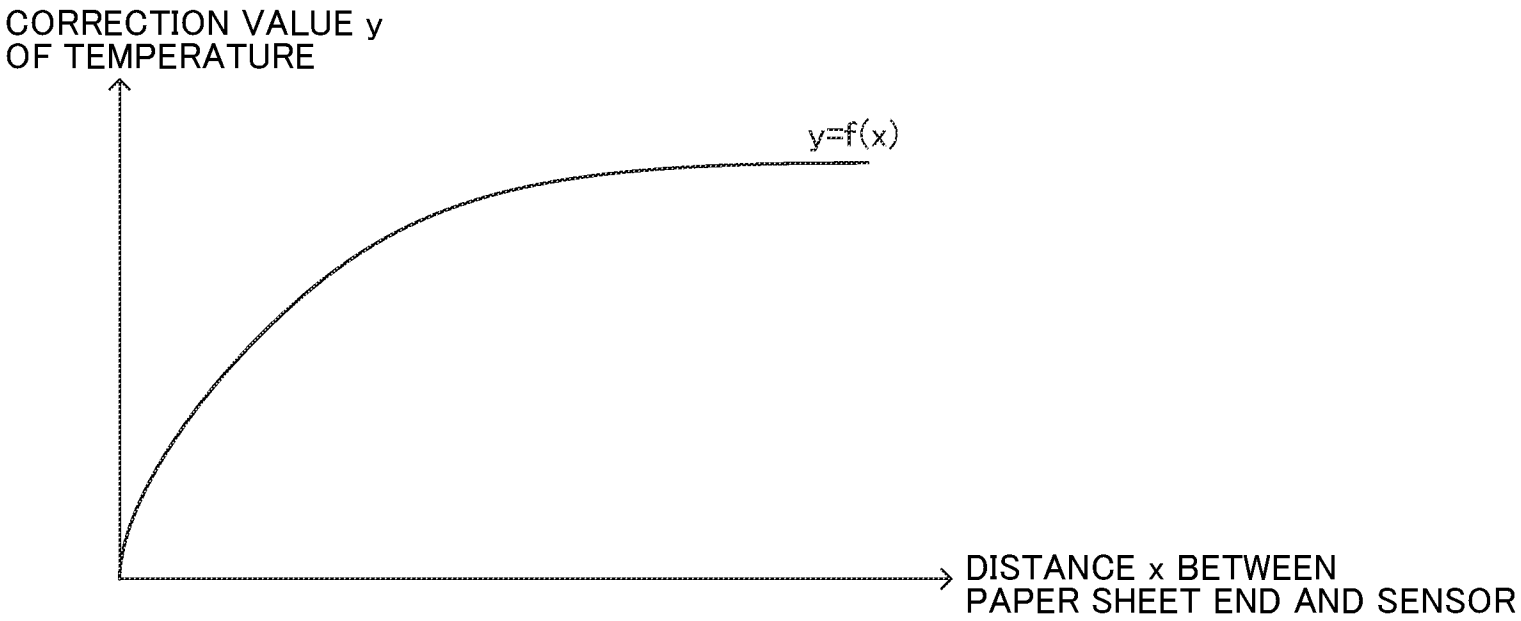
FIG. 8 is a graph illustrating an example of a parameter for correcting a temperature value according to the present embodiment.

A parameter used to correct the measured temperature value can be defined by a function, a table, and the like, and an arbitrary parameter can be adopted. An example of the parameter is illustrated in FIG. 8. FIG. 8 is a graph illustrating an example of the parameter for correcting the temperature value according to the present embodiment. The correction parameter in the present embodiment illustrated in FIG. 8 is a parameter which is given by a function of $y=f(x)$ and corrects the measured temperature value according to the distance from the end of the paper sheet 50 to the temperature sensor 34. That is, in a case where the paper sheet 50 is separated from the temperature sensor 34, a probability that the temperature value detected by the temperature sensor is separated from the actual temperature of the paper sheet 50 is high. Therefore, it is preferable to control the temperature so as to complement the difference. Therefore, by correcting the temperature value detected by the temperature sensor using a difference between the temperatures as a correction value, the paper sheet 50 can be heated to an appropriate temperature.

Note that the parameter for correcting the detected temperature value can be set by experiments and simulations performed in advance. Furthermore, a calculation method of the correction parameter is not limited to the method described above, and various calculation methods can be adopted. Moreover, since a heat quantity conducted to the paper sheet 50 differs according to the type and the conveyance speed of the paper sheet 50, a correction parameter can be set for each case.

Figure 9:
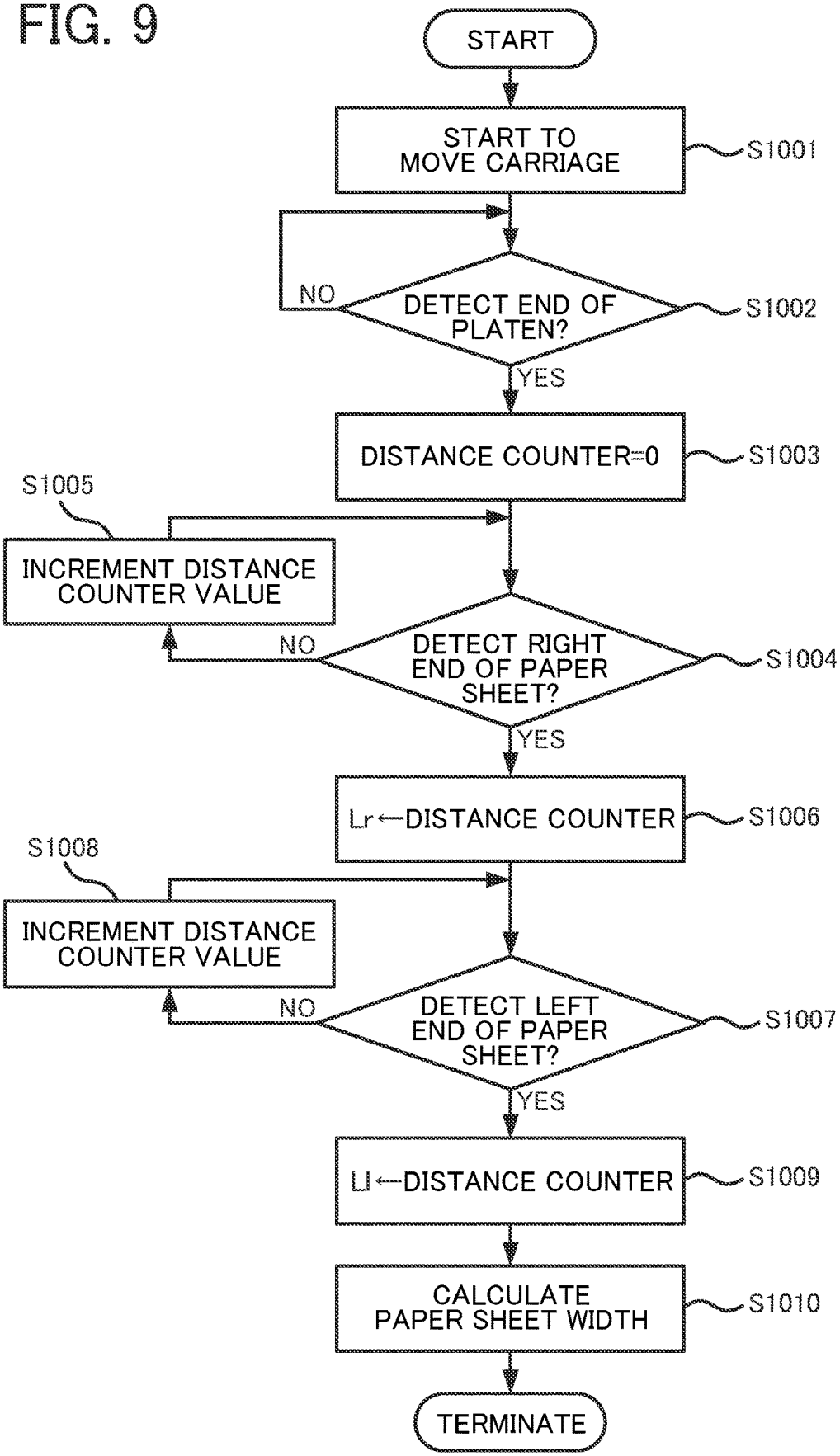
FIG. 9 is a flowchart illustrating processing for calculating a width of a paper sheet by the image forming apparatus according to the present embodiment.

The example for correcting the temperature value in the present embodiment has been described above. Hereinafter, processing executed by the image forming apparatus 10 according to the present embodiment will be described. FIG. 9 is a flowchart illustrating processing for calculating the width of the paper sheet 50 by the image forming apparatus 10 according to the present embodiment. In the following description, the references Lr, Ll, and the like respectively correspond to the references illustrated in FIGS. 7A and 7B.

The image forming apparatus 10 starts processing from step S1000 and starts to move the carriage 12 in step S1001. The carriage 12 moves from the carriage home position in the main scanning direction and continues to move from step S1001.

Thereafter, in step S1002, it is determined whether or not the object detection unit 502 detects the end of the platen 21 according to the movement of the carriage 12. In a case where the end of the platen 21 is not detected (NO), the processing in step S1002 is repeated while the carriage 12 continues to move. In a case where the end of the platen 21 is detected (YES), the procedure proceeds to step S1003. In step S1003, the distance calculation unit 503 sets the number of counts of the distance to zero. The distance can be counted by reading the encoder sheet 22 by the main scanning encoder sensor 24.

In step S1004, it is determined whether or not the object detection unit 502 detects the right end of the paper sheet 50 according to the movement of the carriage 12. In a case where the right end of the paper sheet 50 is not detected in step S1004 (NO), the procedure proceeds to step S1005. In step S1005, a distance counter value is incremented, and then, the procedure returns to step S1004 while the carriage 12 continues to move. In a case where the right end of the paper sheet 50 is detected in step S1004 (YES), the procedure proceeds to step S1006. In step S1006, the distance calculation unit 503 defines a distance counter value which is counted before the time of step S1004 as Lr.

Thereafter, in step S1007, as in step S1004, it is determined whether or not the object detection unit 502 detects the left end of the paper sheet 50 according to the movement of the carriage 12. In a case where the left end of the paper sheet 50 is not detected in step S1007 (NO), the procedure proceeds to step S1008. In step S1008, as in step S1005, the distance counter value is incremented, and then, the procedure proceeds to step S1007 while the carriage 12 continues to move. In a case where the left end of the paper sheet 50 is detected in step S1007 (YES), the procedure proceeds to step S1009. In step S1009, the distance calculation unit 503 defines a distance counter value which is counted before the time of step S1007 as Ll.

After step S1009, the distance calculation unit 503 calculates a difference between the values of the lengths Ll and Lr and calculates the width of the paper sheet 50 in step S1010. Thereafter, in step S1011, the image forming apparatus 10 terminates the processing.

Figure 10:
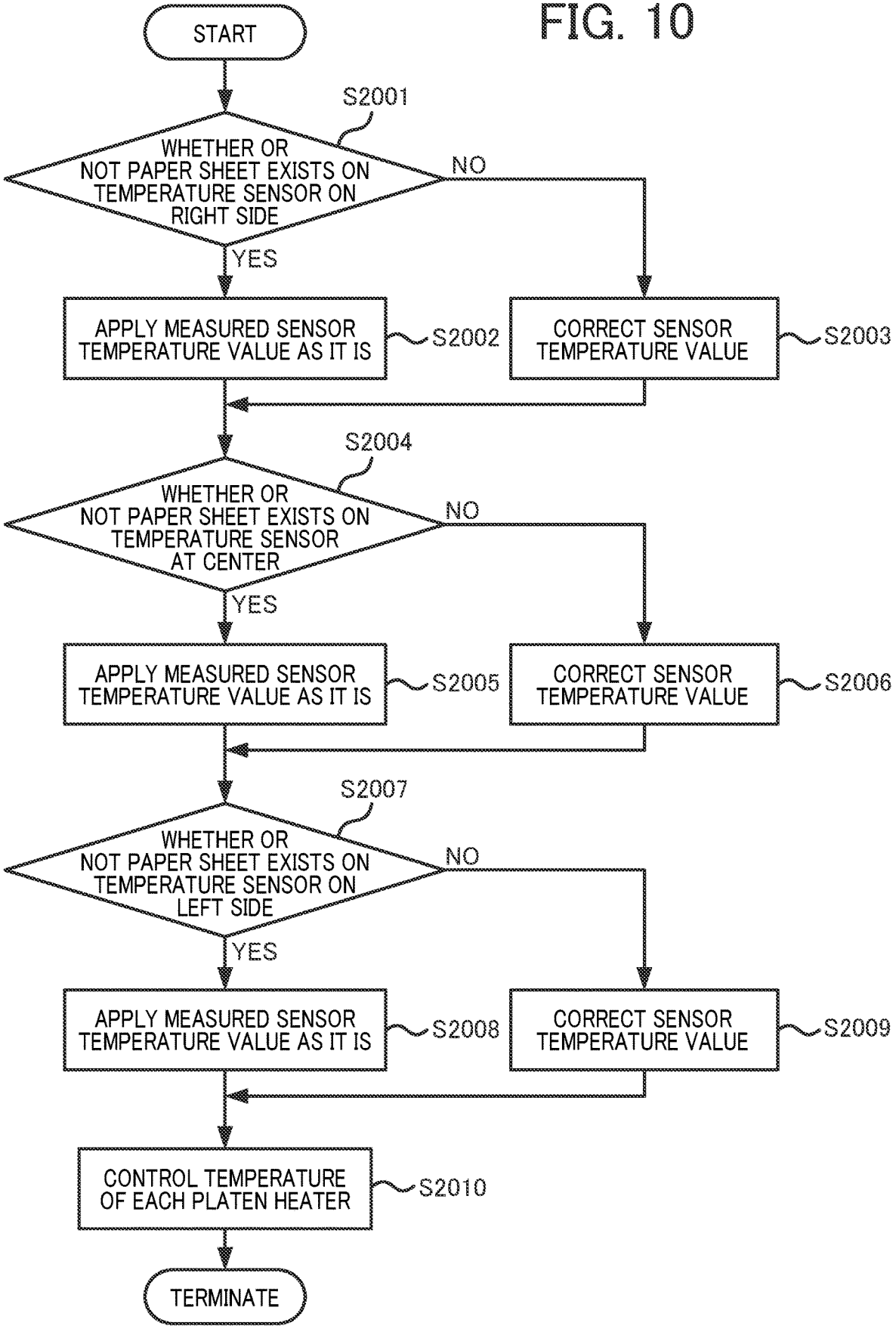
FIG. 10 is a flowchart illustrating processing for controlling a temperature of each platen heater by the image forming apparatus according to the present embodiment.

The image forming apparatus 10 determines the overlap between the platen heater 33 and the paper sheet 50 based on the lengths Lr and Ll and the width of the paper sheet calculated as in FIG. 9 and corrects the sensor temperature value to control the temperature. FIG. 10 is a flowchart illustrating processing for controlling the temperature of each platen heater 33 by the image forming apparatus 10 according to the present embodiment.

The image forming apparatus 10 starts the processing from step S2000. Thereafter, based on the values of the lengths Lr and Ll calculated by the distance calculation unit 503 described with reference to FIG. 9 and the position of each temperature sensor, it is determined whether or not the paper sheet 50 overlaps with each temperature sensor. The distances Lsa, Lsb, and Lsc from the end of the platen 21 to the respective temperature sensors 34*a* to 34*c* are defined by the design and are known values.

In step S2001, it is determined whether or not the paper sheet 50 exists on the temperature sensor 34*a* on the right side, and the procedure branches. Whether or not the paper sheet 50 overlaps with the temperature sensor 34 can be determined according to the following formula (1).

[Expression 1]

$$Lr\ Lsa\ Ll \tag{1}$$

In a case where the distance Lsa from the end of the platen to the temperature sensor 34*a* on the right side and the right end and the left end of the paper sheet 50 satisfy the above formula (1), it can be determined that the paper sheet 50 overlaps with the temperature sensor. Therefore, in a case where the above formula (1) is satisfied in step S2001, it is determined that the paper sheet 50 overlaps with the temperature sensor 34*a* on the right side (YES), and the procedure proceeds to step S2002. In a case where the paper sheet 50 overlaps with the temperature sensor 34, the temperature value detected by the temperature sensor is a value corresponding to the temperature value of the paper sheet 50. Therefore, in step S2002, the measured sensor temperature value is applied as it is.

On the other hand, in a case where the above formula (1) is not satisfied in step S2001, it is determined that the paper sheet 50 does not overlap with the temperature sensor 34*a* on the right side (NO), and the procedure proceeds to step S2003. In a case where the paper sheet 50 does not overlap with the temperature sensor 34, in order to control the temperature in consideration of the heat radiation by the paper sheet 50, the sensor temperature value is corrected in step S2003. The sensor temperature value can be corrected as follows as an example. First, a distance x from the end of the paper sheet 50 to the temperature sensor is calculated, and a correction value y is calculated based on the function (y=f(x)) illustrated in FIG. 8. Then, the value y is subtracted from the measured temperature value so as to obtain the corrected temperature value.

Thereafter, regarding the temperature sensor 34*b* at the center and the temperature sensor 34*c* on the left side, the processing in steps S2004 to S2008 is executed similarly to the temperature sensor 34*a* on the right side.

Thereafter, in step S2010, the heater control unit 506 controls the temperatures of the respective platen heaters 33*a* to 33*c* based on the sensor temperature value. In a case where the sensor temperature value is corrected in steps S2003, S2006, and S2009, the temperature of each platen heater is controlled according to the corrected sensor temperature value in step S2010.

According to various processing described above, the temperature can be controlled based on the sensor temperature value in which the temperature decrease caused by the transfer of the heat to the paper sheet 50 is corrected. With this operation, since the paper sheet 50 can be uniformly heated to a predetermined temperature, occurrence of cockling and the like can be prevented, and the printed image quality can be improved.

In the embodiment described above, an example has been described in which the platen heater 33 is divided in the main scanning direction and the divided heaters are separately controlled. However, the embodiment is not limited to this. Therefore, the configuration may be used in which other heaters including the preheater 31, the post heater 35, the cure heater 37, and the like are divided in the main scanning direction and controlled.

According to the embodiment of the present invention described above, an image forming apparatus, method, and program for making a temperature of a recording medium uniform and controlling the temperature to be an appropriate temperature can be provided.

Each function of the embodiment of the present invention described above can be implemented by a program which can be executed by a device and is written in C, C++, C #, Java (registered trademark), and the like. The program according to the present embodiment can be stored in a device-readable recording medium such as a hard disk device, a compact disc read only memory (CD-ROM), a magneto optical disc (MO), a digital versatile disc (DVD), a flexible disk, an electronically erasable and programmable read only memory (EEPROM), and an erasable programmable read-only memory (EPROM) and distributed, and can be transmitted via a network in a format which can be read by other devices.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention.

Any one of the above-described operations may be performed in various other ways, for example, in an order different from the one described above.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA), and conventional circuit components arranged to perform the recited functions.

The invention claimed is:

1. An image forming apparatus comprising:

a plurality of heaters;

a plurality of temperature sensors formed at positions corresponding to the heaters;

an object sensor configured to detect an overlap region of a medium and the heaters; and control circuitry configured to:

correct temperature information acquired by the temperature sensors, according to the overlap region detected by the object sensor and the positions of the temperature sensors; and control the heaters based on the corrected temperature information.

2. The image forming apparatus according to claim 1, wherein the heaters are aligned in a main-scanning direction.

3. The image forming apparatus according to claim 1, wherein the heaters are platen heaters.

4. The image forming apparatus according to claim 1, wherein the control circuitry corrects the temperature information according to the overlap region.

5. The image forming apparatus according to claim 1, wherein the control circuitry corrects the temperature information in a case where the temperature sensors overlap with the medium.

6. The image forming apparatus according to claim 1, wherein the control circuitry controls a temperature of each of the heaters to rise in a case where the temperature sensors overlap with the medium.

7. The image forming apparatus according to claim 1, wherein the control circuitry corrects the temperature information according to a type of the medium.

8. The image forming apparatus according to claim 1, wherein the control circuitry corrects the temperature information according to a speed at which the medium is conveyed in a sub-scanning direction.

9. A method for controlling a plurality of heaters in an image forming apparatus, the method comprising:

acquiring temperature information at positions of the heaters with a plurality of temperature sensors;

detecting an overlap region of the medium and the heaters;

correcting the temperature information acquired by the temperature sensors, according to the detected overlap region and positions of the temperature sensors; and controlling the heaters based on the corrected temperature information.

10. The method according to claim 9, wherein the detecting and the correcting are repeatedly performed for each of the heaters.

* * * * *